US007341339B2

(12) United States Patent
Yoshikaie

(10) Patent No.: US 7,341,339 B2
(45) **Date of Patent: *Mar. 11, 2008**

(54) TRAY TRANSFERRING CONTROLLER, RECORDING APPARATUS AND LIQUID EJECTING APPARATUS

(75) Inventor: Kazuya Yoshikaie, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/494,813

(22) Filed: Jul. 27, 2006

(65) Prior Publication Data

US 2007/0025795 A1 Feb. 1, 2007

Related U.S. Application Data

(62) Division of application No. 10/871,820, filed on Jun. 17, 2004, now Pat. No. 7,086,729.

(30) Foreign Application Priority Data

Jun. 18, 2003 (JP) ..... 2003-173061

(51) Int. Cl.
*B41J 11/42* (2006.01)
*B41J 2/01* (2006.01)
*B41J 3/407* (2006.01)

(52) U.S. Cl. ..... 347/104; 101/35; 720/601; 720/602

(58) Field of Classification Search ..... None
See application file for complete search history.

(56) References Cited

U.S. PATENT DOCUMENTS 5,548,567 A * 8/1996 Sawai ..... 369/30.39
6,292,452 B1 * 9/2001 Endo et al. ..... 720/638
6,854,843 B2 * 2/2005 Anami et al. ..... 347/104
6,869,235 B2 * 3/2005 Kawaguchi et al. ..... 400/59
2002/0057302 A1 * 5/2002 Shimomura et al. ..... 347/8
2002/0067940 A1 * 6/2002 Sasai et al. ..... 400/61

FOREIGN PATENT DOCUMENTS

JP 57044252 A * 3/1982
JP 60018855 A * 1/1985
JP 03272050 A * 12/1991
JP 06131795 A * 5/1994
JP 06325452 A * 11/1994
JP 10241249 A * 9/1998
JP 2002096514 A * 4/2002

* cited by examiner

*Primary Examiner*—Daniel J. Colilla
(74) *Attorney, Agent, or Firm*—John J. Penny, Jr.; Edwards Angell Palmer & Dodge LLP

(57) ABSTRACT

In a printer capable of performing recording on a recording medium such as an optical disk, a tray on which the recording medium is set is sent upstream or downstream by being nipped by a driving transfer roller rotatably driven by a motor and a driven transfer roller driven and rotated contacting it. When the tray is in a stillness state in a set position where the recording medium can be set, the assist control means generates rotation torque $T_1$. When an external force F comes in effect on the tray, rotation torque $T_2$ is generated by friction between the driving transfer roller and the tray, but the rotation torque T1 becomes an assist force, and the driving transfer roller rotates while any slip between the tray and the driving transfer roller does not occur.

8 Claims, 9 Drawing Sheets

TRAY TRANSFERRING CONTROLLER, RECORDING APPARATUS AND LIQUID EJECTING APPARATUS

The present application is a divisional application of U.S. application Ser. No. 10/871,820, filed Jun. 17, 2004 now U.S. Pat. No. 7,086,729.

The present application claims priority from Japanese Patent Application No. 2003-173061 filed on Jun. 18, 2003, the contents of which are incorporated herein by reference.

BACKGROUND OF THE INVENTION

1. Field of the Invention

The present invention relates to a tray transferring controller capable of performing recording (printing) on a label face of an optical disk represented by a DVD (Digital Versatile Disk) and a recording apparatus provided with the tray transferring controller for controlling the position to the recording apparatus of a tray (object to be driven) on which the optical disk is set. More particularly, the present invention relates to a driven object transferring controller and a liquid ejecting apparatus.

Here, the liquid ejecting apparatus is not limited to the recording apparatus such as a printer, a copier, a facsimile, etc. for performing recording on a recording medium by ejecting ink from a recording head of an inkjet type, and includes an apparatus for ejecting liquid corresponding to the ink onto a medium for ejection corresponding to the recording medium from a liquid ejecting head corresponding to the inkjet type recording head and putting the liquid onto the medium for ejection.

As the liquid ejecting head, besides the recording head, there are a color material ejecting head used for manufacture of a color filter such as a liquid crystal display, an electrode material (conductive paste) ejecting head used for manufacture of an electrode such as an organic EL display or field emission display (FED), a bioorganic material ejecting head for used for manufacture of a biochip, a sample ejecting head as a minute pipette, etc.

2. Description of the Related Art

As a recording apparatus represented by an inkjet printer, there is one that can perform recording by ejecting ink drops directly onto a label face of an optical disk represented by a DVD, where the optical disk as a recording medium is generally set on a plate-shaped tray and then transferred into the recording apparatus while being set on the tray so that recording can be performed on it.

And the tray is configured to be moved into the recording apparatus while being nipped by a transfer roller for transferring the recording medium as the transfer roller is rotatably driven while receiving the power of a motor such as a DC motor as disclosed, for example, in Japanese Patent Application Publication (Laid-open) No. 2002-96514.

Although the recording apparatus is configured to perform recording after the tray on which an optical disk has been set is fed (inserted) into the recording apparatus when recording is performed on the optical disk while taking the tray as to be independent of the recording apparatus as disclosed in JPA 2002-96514, it is possible for the recording apparatus to be configured as follows: the tray is integrally configured with the recording apparatus as one body, and by pressing an operation button when recording is performed on the optical disk, the tray stored inside the recording apparatus projects out of the recording apparatus, i.e. it is sent to a set position on which the optical disk can be set.

In this configuration, while the tray is being at the set position, it is considered whether a user sets the optical disk or leaves the tray as it is with the optical disk not being set.

And then it is considered that the operation button is pressed again, so that the tray returns into the recording apparatus. However, since the tray returns into the recording apparatus by the user, there is also an occasion that the operation to apply an external force directly to the tray is selected.

In this case, the tray is in a state where it is being nipped by the transfer roller which gets rotated by the friction between the tray and the transfer roller. Practically, however, since a constant load is applied by a driving force transfer mechanism between the transfer roller and a motor for transfer driving the transfer roller, a slip between the tray and the transfer roller occurs while the transfer roller keeps stopping rotation. And at this time, the surface condition of the transfer roller becomes worse, which causes a problem that it is difficult to perform the following normal transfer operation of the recording medium. Particularly, in case of the transfer roller whose surface of a metallic shaft body is covered with a coating layer, there is concern that it is peeled off.

SUMMARY OF THE INVENTION

Therefore, it is an object of the present invention to consistently maintain the state of the transfer roller to be proper by making no slip between the tray (an object to be driven) and the transfer roller (driving means) occur even if an external force is applied to the tray, which is capable of overcoming the above drawbacks accompanying the conventional art. The above and other objects can be achieved by combinations described in the independent claims. The dependent claims define further advantageous and exemplary combinations of the present invention.

In order to solve the problems, according to the first aspect of the present invention, a tray transferring controller of a recording apparatus, which includes a recording head for performing recording on a recording medium, a transfer roller including a driving transfer roller rotatably driven for transferring a transfer medium to the recording head by rotating while nipping the transfer medium and a driven transfer roller driven and rotated being pressed and in contact with the driving transfer roller, a transfer motor for rotatably driving the driving transfer roller, and a tray as the transfer medium, on which the recording medium can be set, shaped like a plate which can be sent by the transfer roller, for performing a transferring control of the tray by controlling the transfer motor includes assist control means, with regard to a relation among a first rotation torque applied to the driving transfer roller by controlling the transfer motor based on a first current value, a second rotation torque applied to the driving transfer roller through friction between the tray and the driving transfer roller by applying an external force to the tray being in a stillness state and a load torque required to rotate the driving transfer roller in the stillness state of the tray, for determining the first current value in order that the first rotation torque is smaller than the load torque and that the driving transfer roller rotates with a resultant force of the first rotation torque and the second rotation torque being larger than the load torque when the second rotation torque acts in a same direction as a rotation direction in which the first rotation torque acts, and applying the first current value to the transfer motor when the tray is in the stillness state.

According to the first aspect, the tray transferring controller is provided with the assist control means for applying the first current value to the transfer motor in the stillness state of the tray. Here, since the first current value is set to be a value to generate torque (the first rotation torque) which is smaller than the load torque required to rotate the driving transfer roller from the tray stillness state (a rotation stoppage state of the driving transfer roller), the tray stillness state is maintained. Next, by applying the external force to the tray, the rotation torque applied to the driving transfer roller through the friction between the tray and the driving transfer roller is taken as the second rotation torque, and if the rotation direction by the second rotation torque is the same as the rotation direction by the first rotation torque, the torque to rotate the driving transfer roller increases. And since the first current value is set in order that the driving transfer roller rotates while the resultant force of the first rotation torque and the second rotation torque is larger than said load torque, even if the external force is applied to the tray, the driving transfer roller rotates while any slip between the tray and the driving transfer roller does not occur, whereby it is possible to prevent such a problem that the surface state of the driving transfer roller becomes deteriorated from occurring. In other words, the first rotation torque applied to the driving transfer roller by the first current value assists the second rotation torque applied to the driving transfer roller as the external force is applied to the tray.

According to the second aspect of the present invention, with regard to the first aspect, the tray transferring controller further includes measurement means for measuring a second current value applied to the transfer motor when the tray is sent at a predetermined transferring speed, wherein the assist control means takes a value resulting from subtracting a predetermined value from the second current value obtained by the measurement means or a value resulting from dividing the second current value by a predetermined value as the first current value.

The load state of the transfer motor in operation can be recognized by so-called measurement means for rotating the transfer motor at a predetermined speed and detecting the output value of the integration means with regard to the PID control at that time, and thereby the current value at that time can be obtained by calculation from the output value of the integration means. Accordingly, since the second aspect is to determine the first current value based on the second current value after obtaining the second current value loaded to the transfer motor when the tray is sent at a predetermined transferring speed by the measurement means, it is possible to make the first current value proper in response to the load state of the apparatus.

According to the third aspect of the present invention, with regard to the first or second aspect, the assist control means applies the first current value in order that the first rotation torque acts in a rotation direction to return the tray into the recording apparatus, after transferring the tray in a direction in which the tray projects out of the recording apparatus and making the tray reach a set position in which the recording medium can be set on the tray.

According to the third aspect, since said first current value is applied in order that the first rotation torque acts in the rotation direction to return the tray into the recording apparatus when the tray is in the set position, if the tray is pressed to return by a user when the tray is in the set position, said first rotation torque becomes the assist force and the tray does not slip with regard to the driving transfer roller, so it is possible to prevent the deterioration of the surface state of the driving transfer roller.

According to the fourth aspect of the present invention, with regard to the third aspect, the tray transferring controller further includes tray position detecting means for detecting a position of the tray based on an output of rotation detecting means for detecting a rotation amount of the transfer motor, wherein the tray transferring controller controls the transfer motor in order that the tray returns into the recording apparatus, when the tray position detecting means detects that the position of the tray has been changed by a predetermined amount from the set position.

According to the fourth aspect, when the tray position detecting means for detecting the position of the tray detects a predetermined amount of the position change of the tray, the tray returns into the recording apparatus, and thereby if a user changes the position of the tray by a predetermined amount by applying an external force to the tray, the tray automatically returns into the recording apparatus, which is user-friendly.

According to the fifth aspect of the present invention, with regard to the third or fourth aspect, the tray transferring controller further includes a timer for counting a lapse of time until the tray reaches the set position, wherein the tray transferring controller controls the transfer motor in order that the tray returns into the recording apparatus, when a count value by the timer reaches a predetermined value.

According to the fifth aspect, if the count value by the timer reaches a predetermined value, the tray returns into the recording apparatus, so the tray is not in the state where the tray projects out of the recording apparatus as it is, and it can come into a preferable state in terms of safety.

According to the sixth aspect of the present invention, a tray transferring controller of a recording apparatus, which includes a recording head for performing recording on a recording medium, a transfer roller including a driving transfer roller rotatably driven for transferring a transfer medium to the recording head by rotating while nipping the transfer medium and a driven transfer roller driven and rotated being pressed and in contact with the driving transfer roller, a transfer motor for rotatably driving the driving transfer roller, and a tray as the transfer medium, on which the recording medium can be set, shaped like a plate which can be sent by the transfer roller, for performing a transferring control of the tray by controlling the transfer motor includes assist control means for applying a first current value to the transfer motor in order that the driving transfer roller rotates while assisting a rotation torque applied to the driving transfer roller through friction between the tray and the driving transfer roller when an external force is applied to the tray being in a stillness state and that the tray is maintained to be in the stillness state when the external force is not in action.

According to the sixth aspect, like the first aspect described above, the rotation torque applied to the driving transfer roller by the first current value assists the rotation torque applied to the driving transfer roller as the external force is applied to the tray, so the tray does not slip with regard to the driving transfer roller, and it is possible to prevent the deterioration of the surface state of the driving transfer roller.

According to the seventh aspect of the present invention, a recording apparatus includes a recording head for performing recording on a recording medium, a transfer roller including a driving transfer roller rotatably driven for transferring a transfer medium to the recording head by rotating while nipping the transfer medium and a driven transfer roller driven and rotated being pressed and in contact with the driving transfer roller, a transfer motor for rotatably driving the driving transfer roller, a tray as the transfer medium, on which the recording medium can be set, shaped like a plate which can be transferred by the transfer roller while being nipped by the transfer roller, and a tray transferring controller for controlling a position of the tray by controlling the transfer motor, wherein the tray transferring controller is the tray transferring controller present in any of the first to sixth aspects described above.

According to the seventh aspect, since the recording apparatus capable of performing recording on the recording medium which is set on the tray is provided with the tray transferring controller present in any of the first to sixth aspects described above, it is possible to obtain the same operation and effects as any of the first to fifth aspects described above.

According to the eighth aspect of the present invention, a driven object transferring controller of a driver, which includes a driven object sent to a predetermined direction while receiving a driving force of a motor and driving means driven by the motor for applying a transferring force to the driven object through friction between the driving means and the driven object, for performing a transferring control of the driven object by control the motor includes assist control means for applying a first current value to the motor in order to assist a load applied to the driving means through friction between the driven object and the driving means when an external force is applied to the driven object being in a stillness state and to maintain the driven object to be in the stillness state when the external force is not in action.

According to the eighth aspect, with regard to a driver which includes the driven object and the driving means for changing the position of the driven object by the friction between the driving means and the driven object, even though the external force is applied to said driven object, the driving means applies the assist force to said driven object in advance by the assist control means, so any slip between the driven object and the driving means does not occur, and a proper state can be maintained.

According to the ninth aspect of the present invention, a liquid ejecting apparatus includes a liquid ejecting head for performing liquid ejection on a medium, a transfer roller including a driving transfer roller rotatably driven for transferring a transfer medium to the liquid ejecting head by rotating while nipping the transfer medium and a driven transfer roller driven and rotated being pressed and in contact with the driving transfer roller, a transfer motor for rotatably driving the driving transfer roller, rotation detecting means for detecting a rotation amount of the transfer motor, a tray as the transfer medium, on which the medium where ejection is to be performed can be set, shaped like a plate which can be transferred by the transfer roller while being nipped by the transfer roller, and a tray transferring controller for performing a transferring control of the tray by controlling the transfer motor, wherein the tray transferring controller includes assist control means, with regard to a relation among a first rotation torque applied to the driving transfer roller by controlling the transfer motor based on a first current value, a second rotation torque applied to the driving transfer roller through friction between the tray and the driving transfer roller by applying an external force to the tray being in a stillness state and a load torque required to rotate the driving transfer roller in the stillness state of the tray, for determining the first current value in order that the first rotation torque is smaller than the load torque and that the driving transfer roller rotates with a resultant force of the first rotation torque and the second rotation torque being larger than the load torque when the second rotation torque acts in a same direction as a rotation direction in which the first rotation torque acts, and applying the first current value to the transfer motor when the tray is in the stillness state.

The summary of the invention does not necessarily describe all necessary features of the present invention. The present invention may also be a sub-combination of the features described above. The above and other features and advantages of the present invention will become more apparent from the following description of the embodiments taken in conjunction with the accompanying drawings.

DETAILED DESCRIPTION OF THE INVENTION

The invention will now be described based on the preferred embodiments, which do not intend to limit the scope of the present invention, but exemplify the invention. All of the features and the combinations thereof described in the embodiment are not necessarily essential to the invention.

Figure 1:
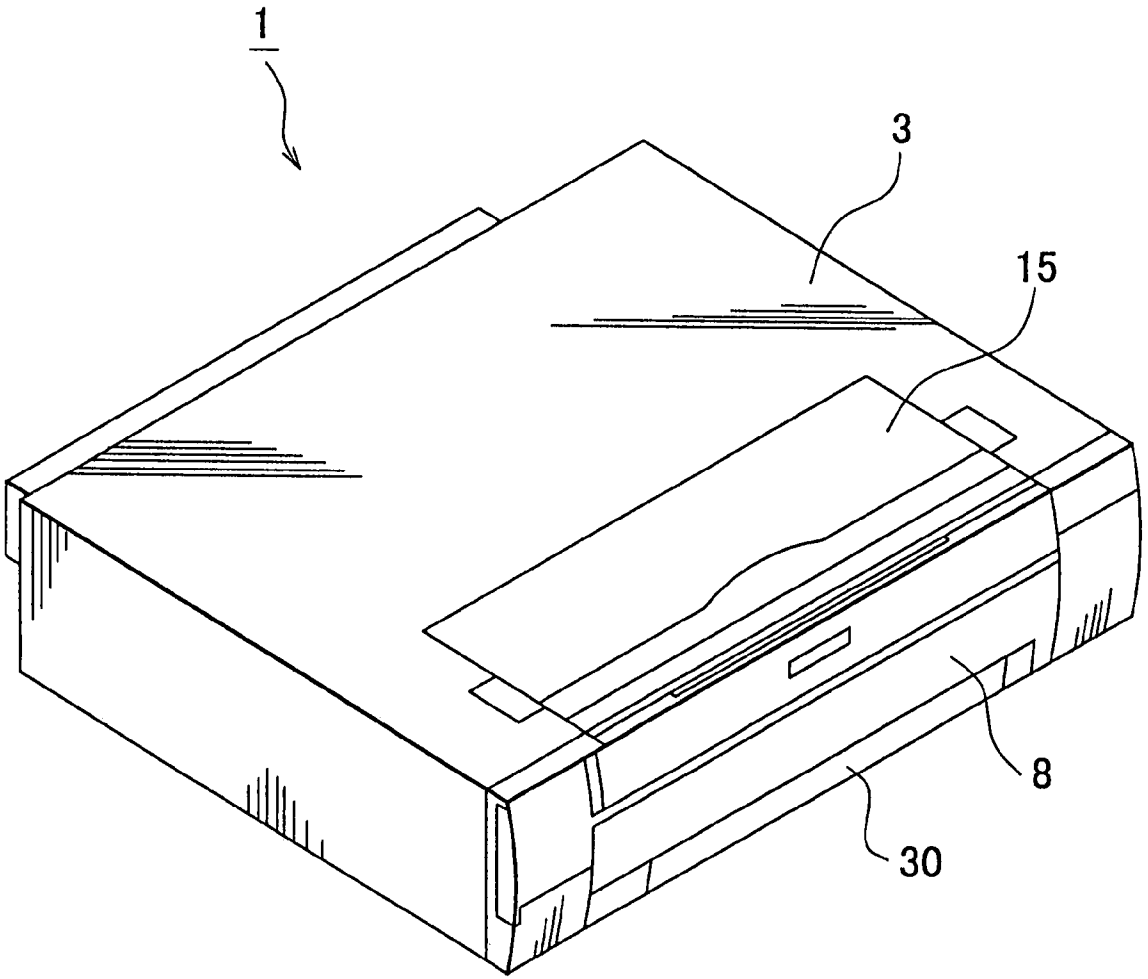
FIG. 1 shows a perspective view of the exterior of a printer related to this invention.
Figure 2:
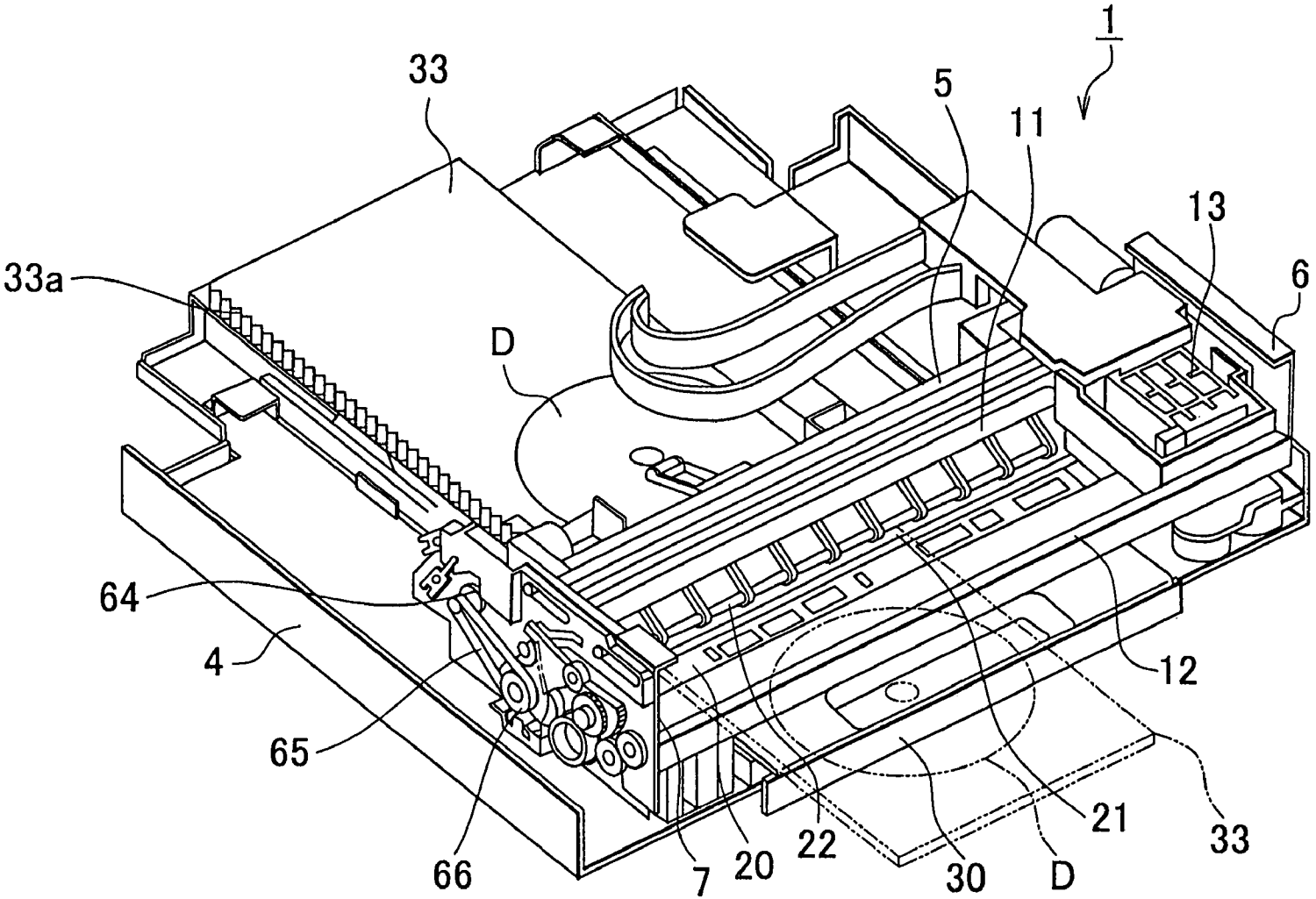
FIG. 2 shows a perspective view of the internal exterior of the printer related to this invention.
Figure 3:
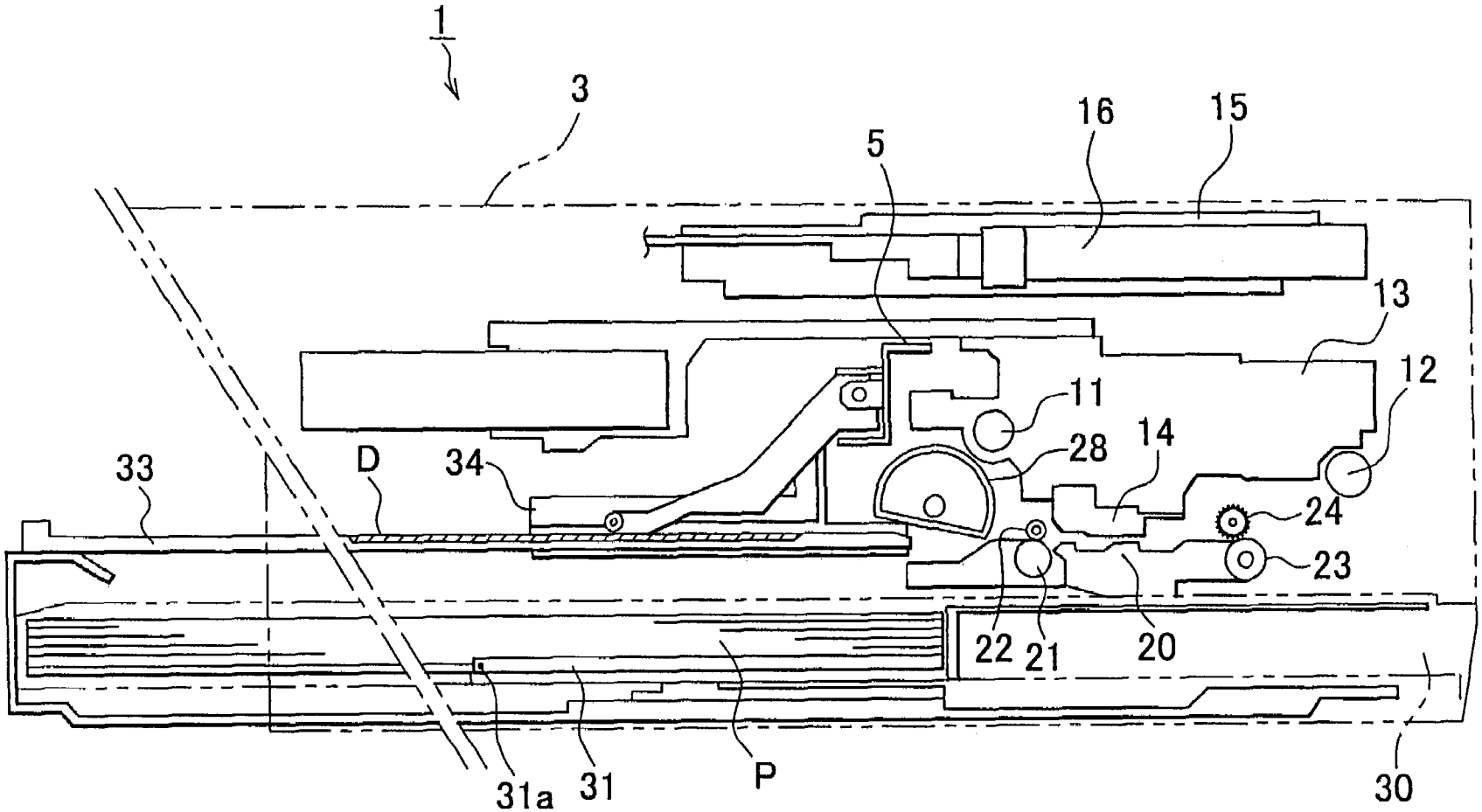
FIG. 3 schematically shows a lateral sectional view of the printer related to this invention.
Figure 4:
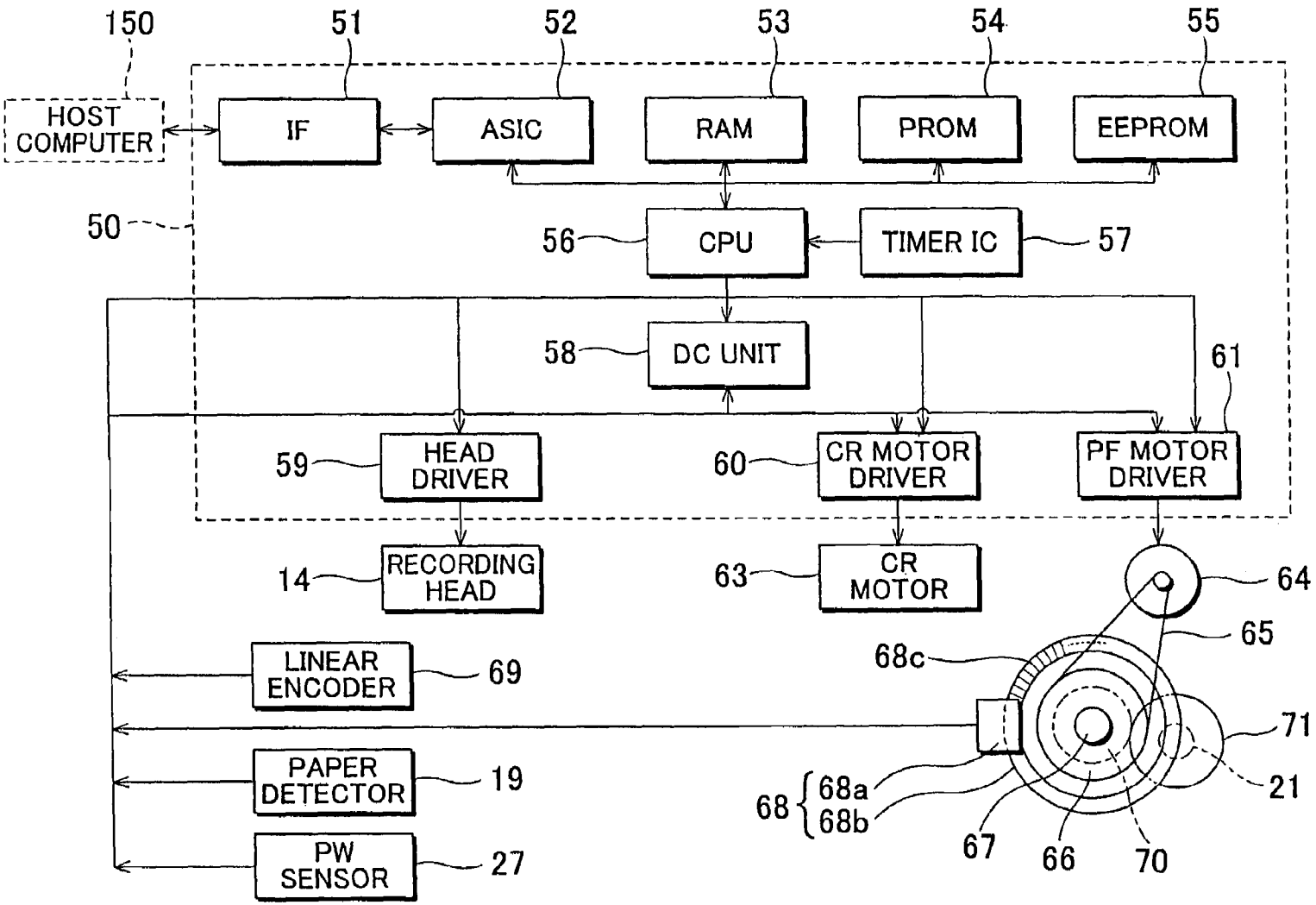
FIG. 4 shows a block diagram of a control unit.

First, referring to FIGS. 1 to 4, the schematic configuration of an inkjet printer (hereafter, referred to as a "printer") 1 as an example of a "recording apparatus" or "liquid ejecting apparatus" according to the present invention will be described. Here, FIG. 1 shows a perspective view of the exterior of the printer 1, FIG. 2 show a perspective view of the exterior of the printer 1 from which its external housing has been removed, and FIG. 3 schematically shows a lateral sectional view of the printer 1. And FIG. 4 shows a block diagram of a control unit 50 for performing various controls of the printer 1.

As shown in FIG. 1, the printer 1 has the shape of a box whose size is generally approximately as large as a video tape recorder, and it is designed to be used being placed on a TV rack. The printer 1 is configured with a front cover 8 on a front surface of a box-shaped housing 3 as shown in the drawing, the front cover 8 is pivotally provided changeable to a state (in use: not shown) where it opens forward or a state (out of use) where it is closed as shown in the drawing, and in the state where it is closed, a recording paper on which recording has been performed can be discharged or a disk tray 33 (see FIG. 2) can come out of or get into it. A paper feed tray 30 is detachably provided below the front cover 8, and it is drawn forward and taken out, so that recording papers can be set. An ink cartridge unit 15 is provided above the front cover 8, and a plurality of ink cartridges 16 (see FIG. 3) are detachably provided to the ink cartridge unit 15 while being arranged in a lateral direction of the printer 1.

And the internal configuration of the printer 1 will be schematically described referring to FIGS. 2 and 3. In FIG. 2, the apparatus body of the printer 1 is configured with a lower chassis 4, a main frame 5 which extends in the lateral direction (a main scanning direction) of the apparatus body, and right and left side frames 6 and 7 provided on both sides of the main frame 5 and parallel to a longitudinal direction (a sub-scanning direction) of the apparatus body. A main carriage guide shaft 11 and a sub-carriage guide shaft 12 which extend in the main scanning direction between the right and left side frames 6 and 7 are axially supported with a distance from each other in the sub-scanning direction.

The main carriage guide shaft 11 and the sub-carriage guide shaft 12 are guide shafts to guide the carriage 13 in the main scanning direction, and the main carriage guide shaft 11 is inserted through a rear section of the carriage 13 whereas the sub-carriage guide shaft 12 supports a front section of the carriage 13 upwards, whereby the distance (platen gap: hereafter referred to as "PG") between a recording head 14 as shown in FIG. 3 and recording papers P is regulated.

Next, the transfer route of the recording paper P and the disk tray 33 will be described referring to FIG. 3. The printer 1 is detachably provided with the paper feed tray 30 on its bottom section as described above. A plurality of pieces of recording papers P can be set in the form of a stack on the paper feed tray 30, below which a hopper 31 is provided. The hopper 31 is pivotally provided around a swing shaft 31*a*, and it pushes the recording papers P which are set upwards, whereby the stack of the recording papers P is forced to be pressed and in contact with a feed roller 28 which is provided above it.

The feed roller 28 has the shape of D when viewed from its side, and its outer surface is formed of a high friction material (e.g. rubber). When the recording papers P are transferred, one on the top of the recording papers P, which is pressed and contact an arc section of the feed roller 28, is fed downstream (to the right in FIG. 3) by the rotation of the feed roller 28. And friction separation means (not shown) which is pressed and contact the arc section of the feed roller 28 is provided below the feed roller 28, and the recording papers P are interposed and pressed between the friction separation means and the feed roller 28, whereby the one on the top of the recording papers P which is to be transferred is separated from the rest of the recording papers P which are to be repeatedly transferred.

A driving transfer roller 21 which is rotatably driven by a transfer (PF) motor 64 (see FIG. 4) and a driven transfer roller 22 which is rotated contacting and accompanying the driving transfer roller 21 are provided downstream of the feed roller 28, and the driving transfer roller 21 is rotatably driven with the recording paper P interposed between the driving and driven transfer rollers 21 and 22, so that the recording paper P is transferred downstream of the recording head 14. The recording head 14 and a platen 20 are provided facing each other up and down downstream of the driving transfer roller 21, and recording is performed on the recording paper P which is being transferred by discharging (ejecting) ink drops as the "liquid" from the recording head 14, while the paper is supported upwards by the platen 20. The recording head 14 is provided on a bottom section of a carriage 13, whereas any ink cartridge is not mounted on the carriage 13 which reciprocates in the main scanning direction, and the plurality of ink cartridges 16 as described are detachably arranged above the main scanning area of the carriage 13 in a row in the main scanning direction. And the ink is supposed to be supplied to the carriage 13 via an ink tube which is not shown.

A driving discharge roller 23 which is rotatably driven by the PF motor 64 and a driven discharge roller 24 which is rotated contacting and accompanying the driving discharge roller 23 are provided downstream of the recording head 14, and the driving discharge roller 23 is rotatably driven with the recording paper P interposed between the driving and driven discharge rollers 23 and 24, so that the recording paper P is discharged out of the printer 1.

Meanwhile, the disk tray 33 (hereafter, referred to as the "tray") on which an optical disk D represented by a DVD (Digital Versatile Disk) is set is disposed above the paper feed tray 30. A rack 33*a* (see FIG. 2) is formed on the side end of the tray 33, and it is configured to move approximately horizontally and straight by the rotation of a pinion gear which is not shown and geared with the rack 33*a*. After an end of the tray is transferred by the rotation of the pinion gear until it is nipped between the driving and driven transfer rollers 21 and 22, the tray 33 is sent in the downstream or upstream direction receiving the driving force by the rotation of the driving transfer roller 21. And when the optical disk D is set or taken out, it is sent up to the position (hereinafter, referred to as a "set position") which is shown as the imaginary line in FIG. 2 while receiving the driving force caused by the rotation of the driving transfer roller 21.

Hereafter, the configuration of the control unit 50 as the "tray transferring controller" or the "driven medium transferring controller" according to the present invention will be described in detail referring to FIG. 4. The control unit 50 which is configured to transmit and receive the data to and from a host computer 150 for supplying the print information to the printer 1 includes an interface (IF) 51 with the host computer 150, an ASIC 52, a RAM 53, a PROM 54, an EEPROM 55, a CPU 56, a timer IC 57, a DC unit 58, a transfer motor (PF motor) driver 61, a carriage motor (CR motor) driver 60, and a head driver 59.

The CPU 56 performs operation processes needed to perform the control program of the printer 1 or other operation processes, and the timer IC 57 generates a periodic interrupt signal needed for various processes to the CPU 56. The ASIC 52 is to control the print resolution or the driving waveform of the recording head 14 based on the print data transmitted from the host computer 150 via the IF 51. The RAM 53 is used as a working area of the ASIC 52 and the CPU 56 or a first storage area of other data, and in the PROM 54 and the EEPROM 55 a control program (firmware) needed to control the printer 1 and the data needed for other data are stored.

The DC unit 58 which is a control circuit for performing the speed control of the DC motor (the CR motor 63 and the PF motor 64) includes a PID control unit, an acceleration control unit, a PWM control circuit, etc. which are not shown in Figures. The DC unit 58 performs various operations for the speed control of the DC motor based on the control instruction sent from the CPU 56 or the output signal from a paper detector 19 for detecting the passage of the recording paper P together with the rotary encoder 68 and the linear encoder 69 and sends the signal to the CR motor driver 60 and the PF motor driver 61.

The PF motor driver 61 drives and controls the PF motor 64 under the control of the DC unit 58. The PF motor 64 allows the driven objects in this embodiment, i.e. the feed roller 28, the driving transfer roller 21 and the driving discharge roller 23 described above as well as the pinion gear (not shown) geared with the rack 33*a* (see FIG. 2) formed on the side end of the tray 33 to rotate so as to perform transferring of the tray 33.

The CR motor driver 60 drives the carriage 13 to reciprocate in the main scanning direction, stops or holds it by controlling the CR motor 63 under the control of the DC unit 58. The head driver 59 drives and controls the recording head 14 in accordance with the print data sent from the host computer 150 under the control of the CPU 56.

The detection signal from the paper detector 19 for detecting the start and end edges of the papers P transferred, the output signal from the rotary encoder 68 as the "rotation detecting means" for detecting the rotation amount, the rotation direction and the rotation speed of the PF motor 64 and the output signal from the linear encoder 69 for detecting the absolute position in the main scanning direction of the carriage 13 are given to the CPU 56 and the DC unit 58. And the output signal from the PW sensor 27 is given to the CPU 56 and the DC unit 58. The PW sensor 27 which is an optical sensor provided on the bottom section of the carriage 13 is used to detect the width of the recording paper P by the scanning of the carriage 13 as well as the position in the transferring direction of the tray 33 by recognizing an identification mark (not shown) given to the tray 33. Further, it is used for the detection of the disk D on the tray 33 or the center position of the disk D.

The rotary encoder 68 includes a disk-shaped scale 68*b* attached to a pulley 66 and including a plurality of light transmission sections 68*c* on its circumference and a detection section 68*a* provided with a light emitting section (not shown) for emitting light to the light transmission sections 68*c* and a light receiving section (not shown) for receiving the light passing through the light transmission sections. Here, the pulley 66 is rotatably driven by the PF motor 64 via an endless belt 65. The pulley 66 is integrally formed with a gear 70 having a shaft 67 as a rotating shaft, and the gear 70 is geared with a gear 71 attached to the shaft end of the driving transfer roller 21. Accordingly, the power of the PF motor 64 is transmitted to the driving transfer roller 21.

When the disk-shaped scale 68*b* rotates, the detection section 68*a* outputs rising and falling signals formed by the light passing through the light transmission sections 68*c*, and the control unit 50 detects the rotation amount, the rotation speed and the rotation direction of the driving transfer roller 21 by receiving these output signals from the rotary encoder 68, whereby it is possible to perform the transferring control of the recording papers P and the tray 33.

Then, the linear encoder 69, which is configured with a sign board (not shown) that is long in the main scanning direction and a light emitting section (not shown) for emitting light to a plurality of light transmission sections (not shown) formed in the main scanning direction on the sign board and a light receiving section (not shown) for receiving the light passing through the light transmission sections, outputs rising and falling signals formed by the light passing through the light transmission sections and detects the absolute position in the main scanning direction of the carriage 13.

Figure 5:
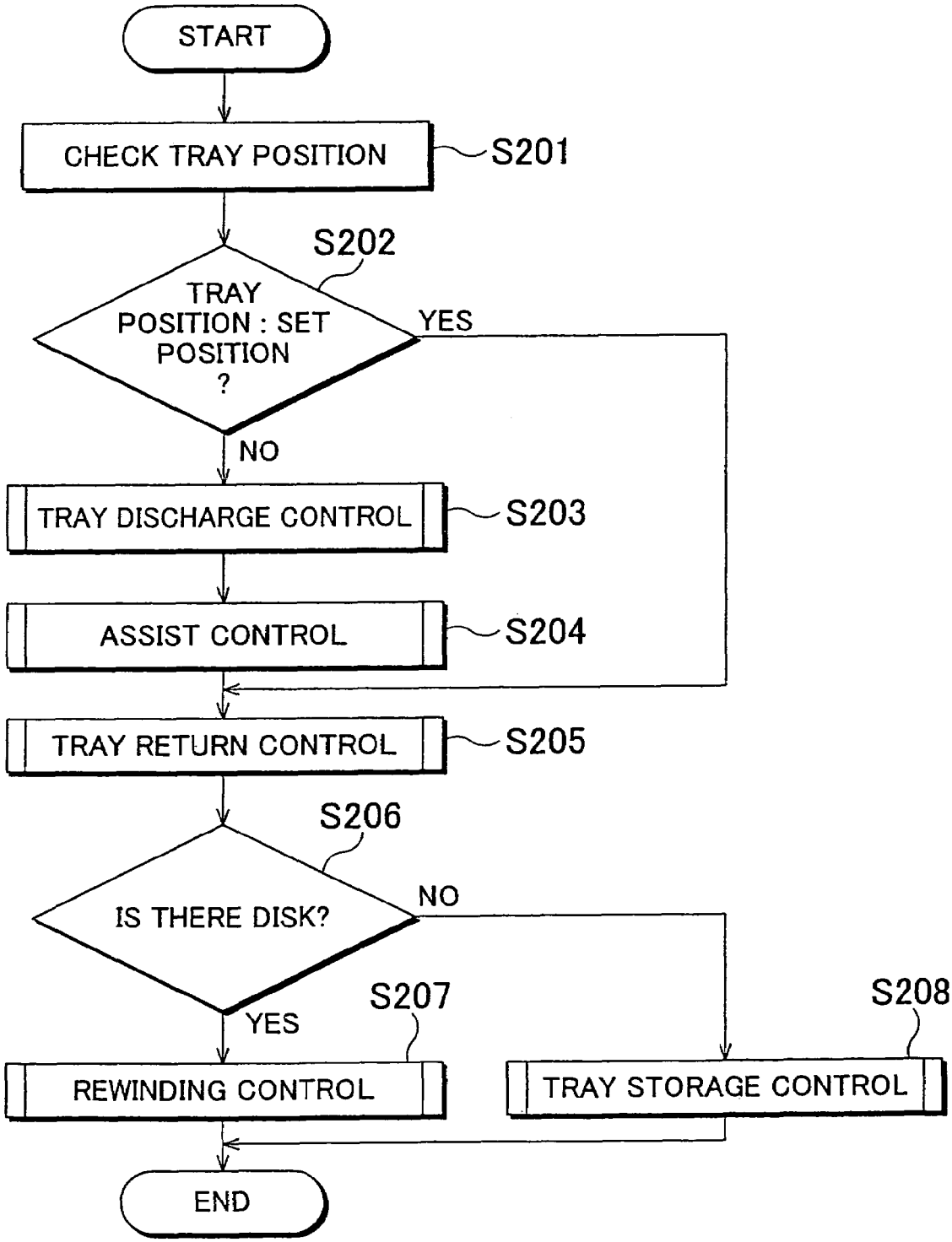
FIG. 5 is a control flowchart when a tray button is pressed down.
Figure 6:
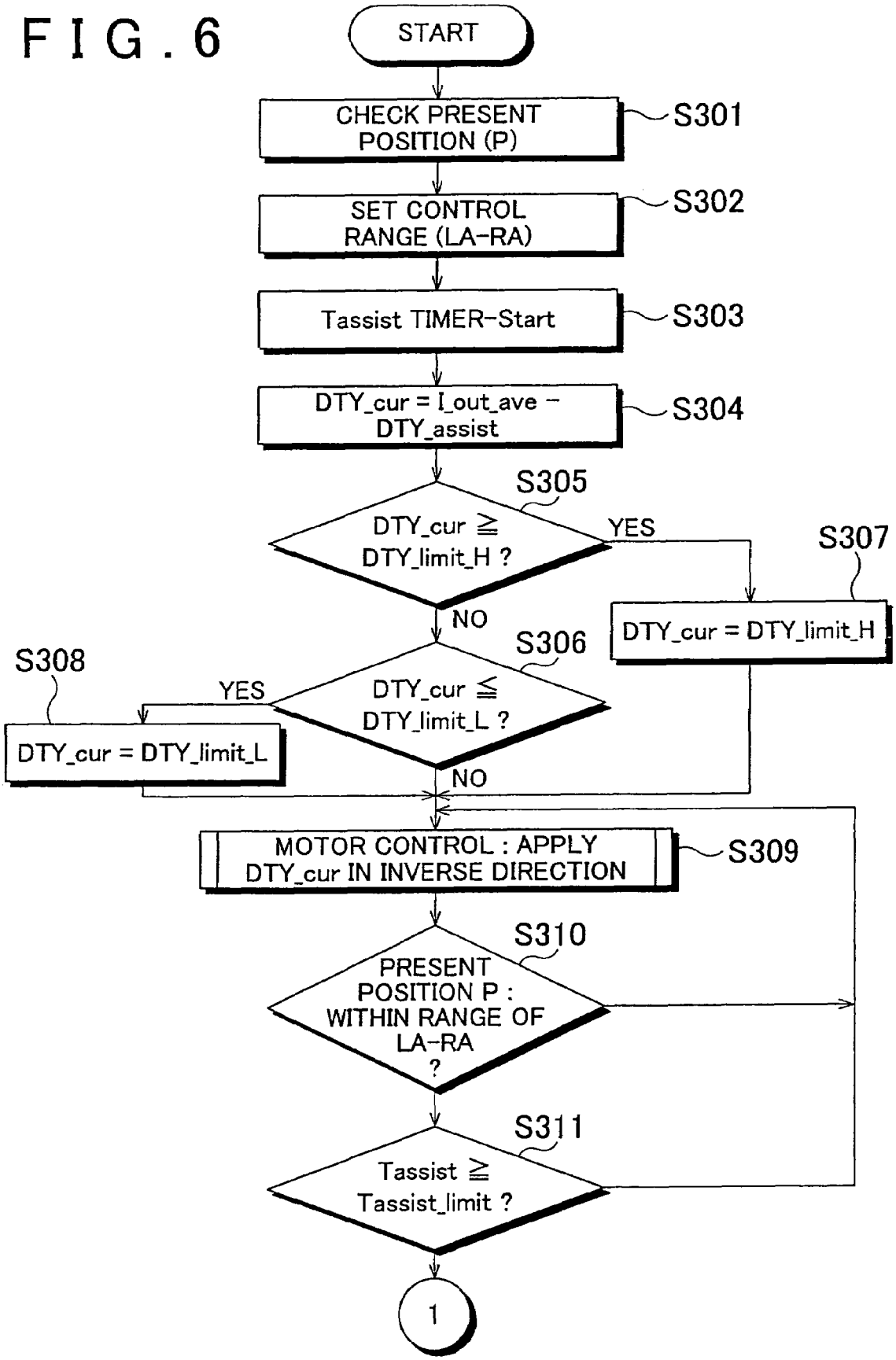
FIG. 6 shows a flowchart of an assist control.
Figure 7:
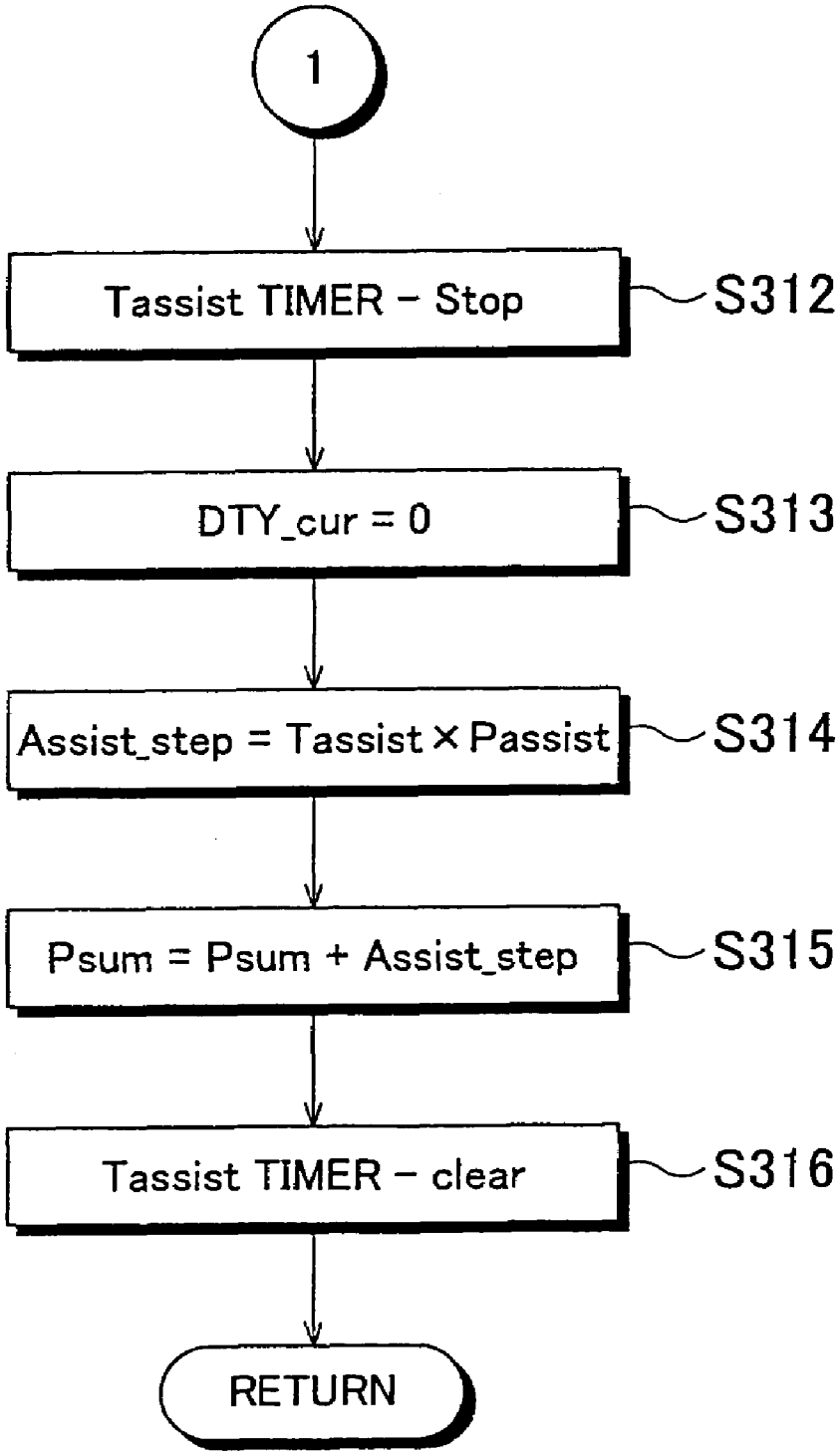
FIG. 7 shows a flowchart of an assist control.
Figure 8:
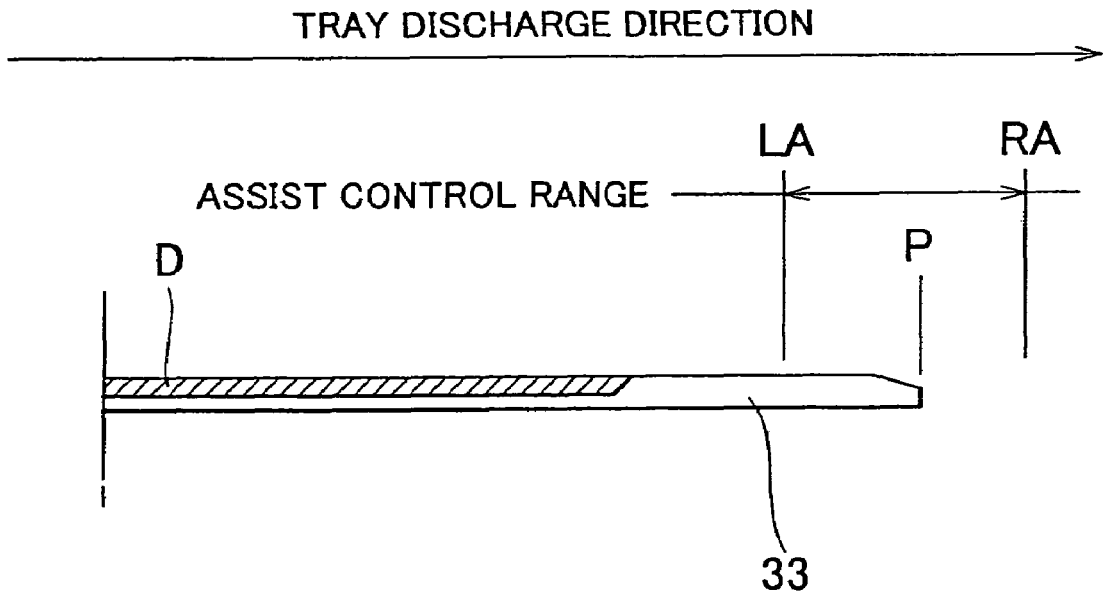
FIG. 8 shows a range of the assist control.
Figure 9:
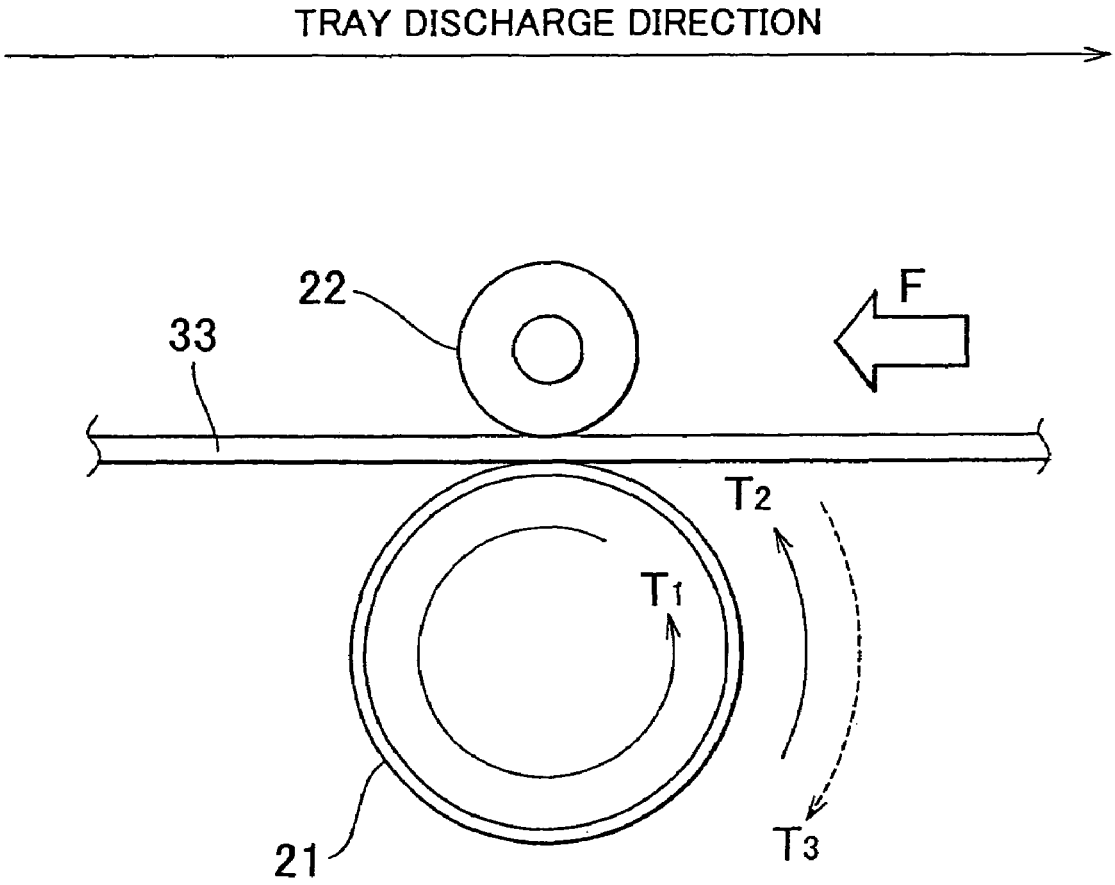
FIG. 9 shows how to perform the assist control.

The printer 1 has been hither to described schematically, and the assist control that the control unit 50 performs when an external force is applied to the tray 33 in a stillness state of the tray 33 will be hereafter described with FIGS. 5 to 9 and other relevant figures. Here, FIG. 5 is a flowchart showing how to control if the tray button is pressed down, FIGS. 6 and 7 are flowcharts showing the assist control, FIG. 8 shows the range of the assist control, and FIG. 9 shows how to perform the assist control.

The tray 33 is also sent to the set position shown by the imaginary line in FIG. 2, as the tray button which is not shown is pressed down when it is stored in the printer 1 as shown in FIG. 2. And when the tray button is pressed down during the time in the set position, it returns into the printer 1. FIG. 5 shows how to control when the tray button is pressed down, and when the tray button is pressed down, the present position of the tray 33 is first checked step S201. If the tray 33 is not in the set position (the negative branch of the step S201), the discharge control of the tray 33 is performed (step S203), and after the tray 33 is sent up to the set position, the assist control is performed (step S204). If the tray 33 is in the set position (the positive branch of the step S201), the tray return control is performed, so that the tray 33 returns into the printer 1 (step S205).

Here, in the tray return control the tray 33 does not return up to its complete storage position, but it returns up to the position at which the PW sensor 27 provided on the bottom section of the carriage 13 can check whether the disk D is set on the tray or not. And if the disk D is set (the positive branch of the step S206), the rewinding control is performed so that recording is performed on the disk D (step S207). If the disk D is not set (the negative branch of the step S206), the tray storage control is performed to put the tray 33 back to the complete storage position (step S208).

Next, the outline of the assist control will be described. FIG. 9 shows the tray being nipped between the driving transfer roller 21 and the driven transfer roller 22. When the driving transfer roller 21 rotates, the tray 33 is sent upstream or downstream by the friction between the tray 33 and the circumferential surface of the driving transfer roller 21 being rotatably driven.

Here, when the PF motor 64 is in the stoppage state, i.e. the tray 33 is in the stillness state, an external force in the direction as shown by the symbol F in which the tray returns into the printer 1 is applied. In this case, it is considered that when the tray 33 is in the stillness state in the set position, a user does not press down the tray button but apply the external force F in FIG. 9 to return the tray 33 into the printer 1. That is because if the user applies a force in the direction to put the tray 33 back to the printer 1, it is expected that the control to return the tray 33 into the printer 1 is automatically performed.

When the external force F is applied, the rotation torque (second rotation torque) shown by the symbol $T_2$ is applied to the driving transfer roller 21 which is in the rotation stoppage state. Here, in order to rotate the driving transfer roller 21 which is in the rotation stoppage state, it is necessary to overcome through a rotation load (load torque shown by the symbol $T_3$) received from a gear (see FIG. 4) which transmits the power from the PF motor 64 to the driving transfer roller 21 and other dynamic mechanism which obtains its power from the gear. However, since the rotation torque $T_2$ is generated by the friction between the tray 33 and the driving transfer roller 21, even though the external force becomes large, the rotation torque $T_2$ does not get increased after reaching a predetermined value, and consequently a slip between the tray 33 and the driving transfer roller 21 occurs, and there is concern that the circumferential surface of the driving transfer roller 21 might be damaged. Particularly, since the driving transfer roller 21 is formed by covering a metallic shaft body with a coating layer, there is a problem that the coating layer is peeled off, and then the transfer operation for the next recording paper P or tray 33 cannot be normally performed.

Accordingly, in the rotation stoppage state of the driving transfer roller 21 (the stillness state of the tray 33), when the external force F is applied by controlling the PF motor 64 and generating the rotation torque $T_1$ assisting the rotation torque $T_2$ in advance, the surface state of the driving transfer roller 21 is maintained to be proper by making the driving transfer roller 21 rotate while no slip between the tray 33 and the driving transfer roller 21 occurs in order that the relation $T_1+T_2>T_3$ is satisfied. That is the outline of the assist control.

Hereafter, the assist control will be described in more detail based on FIGS. 6 and 7. First, the present position of the tray 33 is checked (step S301), and the assist control range (LA-RA) is set (step S302). The assist control range is a predetermined range within which the assist control is performed when the tray 33 is positioned in a predetermined range, and as shown in FIG. 8 it is set upstream (LA) and downstream (RA) from the position (present position P) of the edge of the tray 33 when the tray 33 is in the set position (in this embodiment, approximately 1 to 2 mm in width). The values of LA and RA are stored in a memory not shown.

Next, Tassist timer is started (step S303). Tassist timer is the timer for counting a predetermined time in order to stop the assist control and return to a main routine when a predetermined time is reached, and it counts until it becomes Tassist_limit. The value of Tassist_limit is stored in a memory not shown.

Next, DTY_cur as a "first current value" applied to the PF motor 64 is obtained (step S304). DTY_cur is obtained by subtracting DTY_assist from I_out_ave as a "second current value" in this embodiment. Here, I_out_ave is the current value of the PF motor 64 when the tray 33 is sent to the set position at a predetermined speed, i.e. the value equivalent to a load when the tray 33 is sent by rotatably driving the driving transfer roller 21, and it is obtained in advance by measurement means and stored in a memory not shown.

The measurement means is already known as to obtain the current value calculated from an output value by rotating the PF motor 64 at a predetermined rotation speed and detecting the output value of the integration means of the PID control unit at that time in order to recognize the load state of the PF motor 64, and particularly it is disclosed in Japanese Patent Application Publication (Laid-Open) No. 2003-79172, so it will not described in detail. In addition, DTY_assist is a constant value (current value) determined in advance, and although DTY_cur is obtained by subtracting it from I_out_ave in this embodiment, DTY_cur may be obtained by DTY_cur=I_out_ave/DTY_assist as a coefficient value for division of I_out_ave.

The value of DTY_cur is the value not to rotate the driving transfer roller 21, i.e. the value to maintain the state where the tray 33 stands still in the set position, and it is the current value to generate the rotation torque $T_1$ shown in FIG. 9. In this embodiment, DTY_cur is generally set to be the value of approximately 50% as much as I_out_ave, and with such value in the practical apparatus the proper range can be obtained by properly changing DTY_assist and applying it to the PF motor 64.

Next, whether DTY_cur exceeds DTY_limit_H or not is checked (step S305), and if it exceeds, DTY_cur is set to be DTY_limit_H (step S307). This is a measure in case that a certain problem occurs when measurement to obtain I_out_ave is performed. By the similar cause, whether DTY_cur is less than DTY_limit_L or not is checked (step S306), and it is less than DTY_limit_L, DTY_cur is set to be DTY_limit_L (step S307). Any of DTY_limit_H and DTY_limit_L is set to be the current value to generate the rotation torque $T_1$ in order that it maintains the rotation stoppage state of the driving transfer roller 21 being in the rotation stoppage state, and it exceeds the load torque $T_3$ while cooperating with the rotation torque $T_2$ when the external force F (the rotation torque $T_2$: see FIG. 9) is in action (i.e., the upper or lower limit value to perform the assist control). Further, DTY_limit_H and DTY_limit_L are stored in a memory not shown.

And DTY_cur obtained in the above way is applied to the PF motor 64 (step S309) until the present position P is out of the range of LA to RA (step S310) or until the timer Tassist reaches Tassist_limit (step S311). Here, the direction in which DTY_cur is applied is the direction in which the rotation torque $T_1$ shown in FIG. 9 is generated, i.e. the direction to assist the rotation torque $T_2$ generated by the external force, and it is the direction to return the tray 33 into the printer 1. In addition, whether the present position P is within the range of LA to RA or not is judged by counting the output signal (pulse) of the rotary encoder 68, i.e. it becomes the tray position detecting means.

And if the present position P is out of the range of LA to RA or the timer Tassist reaches Tassist_limit, the timer Tassist is stopped (step S312), DTY_cur is set to be zero so that the complete off-brake state comes (step S313). Next, Assist_step is obtained by Tassist×Passist (step S314). Here, Assist_step is the value indicating the work amount that the PF motor 64 performs by the assist control, and it is obtained by multiplying the assist control time Tassist by a constant Passist. And the work amount Assist_step obtained is added to Psum which is the accumulation value of the work amount generated by the PF motor 64 (step S315). Accordingly, the amount of heat generation of the PF motor 64 can be managed. And Tassist timer is cleared (step S316), the control returns to the routine of a higher class.

As above, if the tray 33 is sent to the set position as the tray discharge control is performed because a user presses down the tray button, the tray 33 stands still in the set position until a predetermined time (Tassist_limit) is reached. During this time, if the assist control is performed so that a user sets the disk D or the tray 33 returns into the printer 1 with the disk D not being set, the driving transfer roller 21 rotates while the tray 33 does not slip with regard to the driving transfer roller 21. And if the position of the edge of the tray 33 is out of the assist control range of LA to RA, the tray return control is performed, and the tray 33 automatically returns into the printer 1. As above, the slip of the tray 33 with regard to the driving transfer roller 21 is prevented, and the circumference surface of the driving transfer roller 21 is not damaged. And if a predetermined time is reached by Tassist timer, the tray return control is performed even if any operation is performed, and thereby the tray 33 can come into a desirable state in terms of safety while it is not in the state where it projects in the set position.

In addition, although the assist control described above is to generate the assist force in the direction (the rotation torque $T_1$ in FIG. 9) to put the tray 33 in the set position back to the printer 1 in this embodiment, the assist force may be generated in the direction (the opposite direction to the rotation torque $T_1$ in FIG. 9) in which the tray 33 projects out of the printer 1 while the tray 33 is in the state where it projects a little from the printer 1. That is, in this case, that is because the probability that the external force in the direction (the opposite direction to the external force in FIG. 9) in which a user draws the tray 33 out of the printer 1 is applied to the tray 33 is high. In other words, the assist control related to this invention is to consider the direction whose probability that the external force is applied is high through which position the tray 33 is standing still in and drive and control the PF motor 64 based on it.

Accordingly, the object of the assist control is not limited to these embodiments described above, and if an object to be driven (the tray 33 in this embodiment), a motor for driving it (the PF motor 64 in this embodiment), and driving means (the driving transfer roller 21 in this embodiment) for applying a driving force by the friction to the object to be driven receiving the power of the motor exist, the slip between the object to be driven and the driving means is prevented by performing the assist control, and thereby the proper state can be maintained.

Further, a program for performing the assist control described above may be configured to be stored in memory means such as the ROM 54 or the EEPROM 55 and read out by the CPU 56 in response to needs or may be configured to be realized by a control circuit mounted on the DC unit 58. Alternatively, it may also be configured to supply a control instruction to the control unit 50 of the printer 1 while being stored on a recording medium (e.g. a hard disk device) provided to the host computer 150 or a recording medium (e.g. a CD-ROM) that other host computer 150 can read out and executed by the host computer 150.

Although the present invention has been described by way of exemplary embodiments, it should be understood that those skilled in the art might make many changes and substitutions without departing from the spirit and the scope of the present invention which is defined only by the appended claims.

What is claimed is:

1. A tray transferring controller of a recording apparatus, comprising:

a transfer roller unit comprising: a driving transfer roller rotatably driven for transferring a tray to a recording head by rotating, said driving transfer roller also is rotatable by friction between said tray and said driving transfer roller caused by application by an external force on the tray; and a driven transfer roller driven and rotated being pressed and in contact with said driving transfer roller;

a transfer motor connecting to said driving transfer roller; and an assist controller coupled to an input of said transfer motor, said assist controller generating a first current value and outputting said first current value to said transfer motor, when said tray is in a stillness state, to generate a first rotation torque on said driving transfer roller, said first rotation torque is smaller than a load torque that is required to rotate said driving transfer roller in said stillness state of said tray, wherein said driving transfer roller rotates due to a resultant force of said first rotation torque and a second rotation torque, said second rotation torque being applied to said driving transfer roller through the friction between said tray and said driving transfer roller by applying an external force to said tray being in a stillness state, said resultant force being larger than said load torque.

2. A tray transferring controller as claimed in claim 1, wherein said friction is larger than said external force.

3. A tray transferring controller as claimed in claim 1, wherein said first current value is a value resulting from subtracting a predetermined value from a second current value or a value resulting from dividing said second current value by a predetermined value, said second current value allowing said transfer motor to rotate said driving transfer roller at a predetermined speed.

4. A tray transferring controller as claimed in claim 1, wherein said assist controller applies said first current value in order that said first rotation torque acts in a rotation direction to return said tray into said recording apparatus, after transferring said tray in a direction in which said tray projects out of the recording apparatus and making said tray reach a set position at which said recording medium can be set on said tray.

5. A tray transferring controller as claimed in claim 4, further comprising:

rotation detecting means for detecting a rotation amount of said transfer motor, and tray position detecting means for detecting a position of said tray based on an output of said rotation detecting means, wherein said tray transferring controller controls said transfer motor in order that said tray returns into said recording apparatus, when said tray position detecting means detects that said position of said tray has been changed by a predetermined amount from said set position.

6. A tray transferring controller as claimed in claim 4, further comprising:

a timer for counting a lapse of time until said tray reaches said set position, wherein said tray transferring controller controls said transfer motor in order that said tray returns into said recording apparatus, when a count value by said timer reaches a predetermined value.

7. A recording apparatus comprising: a recording head for performing recording on a recording medium; and a tray transferring controller as set forth in claim 1 for controlling a position of said tray by controlling said transfer motor.

8. A liquid ejecting apparatus comprising:

a liquid ejecting head for performing liquid ejection on a medium;

a transfer roller unit comprising: a driving transfer roller rotatably driven for transferring a transfer medium to said liquid ejecting head by rotating, said driving transfer roller also is rotatable by friction between said transfer medium and said driving transfer roller caused by application by an external force on the tray; and a driven transfer roller driven and rotated being pressed and in contact with said driving transfer roller;

a transfer motor for rotatably driving said driving transfer roller;

a tray as said transfer medium, on which said medium where ejection is to be performed can be set, said tray being shaped like a plate which can be transferred by said transfer roller unit;

a tray transferring controller for performing a transferring control of said tray as said transfer medium by controlling said transfer motor, said tray transferring controller comprising:

an assist controller coupled to an input of said transfer motor, said assist controller generating a first current value and outputting said first current value to said transfer motor, when said tray is in a stillness state, to generate a first rotation torque on said driving transfer roller, said first rotation torque is smaller than a load torque that is required to rotate said driving transfer roller in said stillness state of said tray as said transfer medium, wherein said driving transfer roller rotates due to a resultant force of said first rotation torque and a second rotation torque, said second rotation torque being applied to said driving transfer roller through the friction between said transfer medium and said driving transfer roller by applying an external force to said transfer medium being in a stillness state, said resultant force being larger than said load torque.

* * * * *